US006338408B1

(12) United States Patent
Anderson

(10) Patent No.: US 6,338,408 B1
(45) Date of Patent: Jan. 15, 2002

(54) DEVICE FOR HOLDING BLISTER PACK

(75) Inventor: Gregor J. M. Anderson, Hertfordshire (GB)

(73) Assignee: Glaxo Group Limited, Greenford (GB)

( * ) Notice: Subject to any disclaimer, the term of this patent is extended or adjusted under 35 U.S.C. 154(b) by 0 days.

(21) Appl. No.: 09/446,805

(22) PCT Filed: Jun. 29, 1998

(86) PCT No.: PCT/GB98/01892

§ 371 Date: Mar. 9, 2000

§ 102(e) Date: Mar. 9, 2000

(87) PCT Pub. No.: WO99/01101

PCT Pub. Date: Jan. 14, 1999

(30) Foreign Application Priority Data

Jun. 30, 1997 (GB) ..... 9713876

(51) Int. Cl.[7] ..... B65D 83/04

(52) U.S. Cl. ..... 206/538; 206/1.5; 206/528; 206/531

(58) Field of Search ..... 206/1.5, 528, 531, 206/532, 536, 538; 221/25, 64, 69, 87, 89

(56) References Cited

U.S. PATENT DOCUMENTS 4,485,915 A 12/1984 Berghahn
5,109,984 A * 5/1992 Romick ..... 206/531
5,129,527 A 7/1992 Lataix
5,323,907 A * 6/1994 Kalvelage ..... 206/531
5,348,158 A * 9/1994 Honan et al. ..... 206/538
5,377,839 A * 1/1995 Relyea et al. ..... 206/531
5,437,371 A 8/1995 Lataix
5,489,025 A * 2/1996 Romick ..... 206/531
5,575,399 A 11/1996 Intini
5,823,341 A * 10/1998 Nakasuji ..... 206/1.5
5,988,429 A * 11/1999 Coe ..... 221/25

FOREIGN PATENT DOCUMENTS

EP 0 542 324 A1 5/1993
WO WO 95/23101 8/1995

* cited by examiner

*Primary Examiner*—David T. Fidei
(74) *Attorney, Agent, or Firm*—Nixon & Vanderhye

(57) ABSTRACT

A device for holding blister packs has first and second members, which are operable between an open condition to allow removal of products from the blister packs, and a closed condition to prevent this. The blister packs are not removable from the device. The blister packs may be retained by panels overlying their bases. The members can be retained in their closed conditions by a child-resistant closure.

20 Claims, 9 Drawing Sheets

FIG. 2
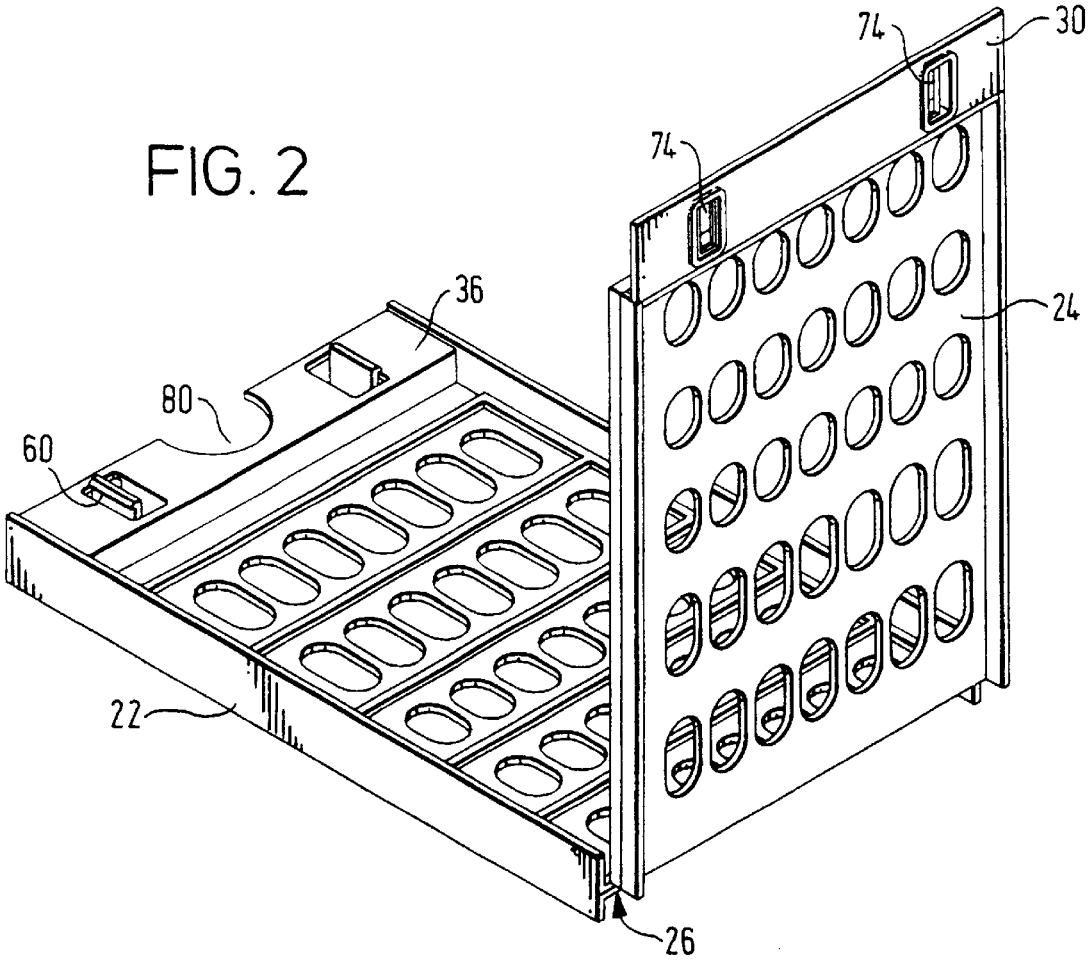
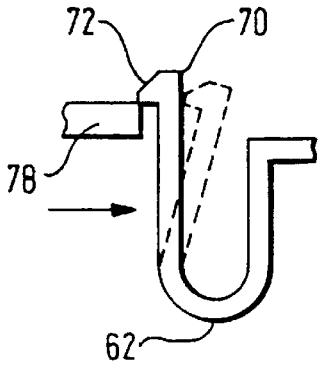
FIG. 6

DEVICE FOR HOLDING BLISTER PACK

BACKGROUND OF THE INVENTION

The present invention relates to a device for holding blister packs, and to blister packs.

One widespread form of packaging, particularly for medicines, is the blister pack. A blister pack comprises a thin resilient sheet, normally of plastics material, in which hollows or "blisters" are formed, all facing away from one side of the sheet. These blisters accommodate products, for example medication products, usually in the form of tablets or capsules. A tearable foil is sealingly attached to the sheet to cover the blisters and retain the products therein. To remove a product, a blister is pressed down, toward the body of the sheet, and this action forces the product through the tearable foil and out of the pack.

It can be problematic to have blister packs stored loose, particularly if the packs contain products which are dangerous for children. Accordingly, a number of devices for holding blister packs in such a way as to prevent easy access to the products have been proposed.

In one example, shown in U.S. Pat. No. 5,323,907 (Kalvelage), the blister packs can be housed in a frame formed with openings through which the products may be dispensed from the blisters. The openings are specially shaped to provide partial obstruction to the passage of the products. The ability of the device to prevent access to the products thus depends on the level of obstruction, rather than the device having open and closed conditions respectively allowing either easy access or no access.

Another approach is shown in U.S. Pat. No. 5,129,527 (Lataix). This discloses a blister pack which folds inwardly on itself to form two halves arranged foil-to-foil, the two halves then being held together along their edges remote from the fold line by a locking device. There is however a risk with this type of arrangement that an implement such as a knife may be inserted between the two halves of the folded blister pack at its exposed side edges, allowing access to the foil side of the blister pack and thus potentially to the products.

A further approach is to put the packs in a container, in order to prevent access to the products when the container is closed. A container of this type is disclosed in, for example, U.S. 4,485,915 (Berghahn). In this document, a blister pack is held in a shallow tray, which can be slid in and out of a sleeve. There are no specific means to retain the blister pack on the tray, and if for example the sleeve is held upside-down when the tray is pushed out, the blister pack could simply fall out.

A similar container is disclosed in DE 3840080 (Lobermeier). Here, a blister pack can be slid into a holder. The holder has an array of holes arranged below the blister pack in use, which allow products to be pushed out from the blisters. The holes can be covered by a hinged cover to prevent the products from being dispensed. The blister pack can be easily removed from the holder, for example to allow an empty blister pack to be replaced by a full one. However, since the blister pack can be easily removed, there is a risk that children can gain access to the products simply by removing the blister pack from the holder.

BRIEF SUMMARY OF THE INVENTION

According to a first aspect of the present invention, there is provided a device for holding a blister pack, comprising first and second members operable between an open condition in which products may be removed from a blister pack held by the device and a closed condition in which products may not be removed, and retaining means for the blister pack allowing products to be removed from the blister pack when the device is open, the retaining means preventing the blister pack from being removable from the device.

The retaining means ensure that the blister pack will stay in its position in or on the device, even when the device is opened. If the blister pack is not retained in place, then it may fall out during the opening procedure, and in particular if the device is dropped when open, which is clearly inconvenient. Further, if the device is being used to store a number of packs containing tablets which must be taken in accordance with a particular dosing regime, having the packs fall out is particularly inconvenient and indeed possibly dangerous, as the packs may then be put back in the device in the wrong positions, leading to possible over- or under-dosing.

In addition, since the blister pack is not removable from the device, a child who manages to open the device would not be able to remove the blister pack from the device and then gain relatively easy access to the products.

It is preferred that the retaining means are tamper-evident. Any attempt to remove the blister pack from the retaining means will then leave obvious signs, which can alert a patient. Further, if the blister pack is to be inserted into the device by a pharmacist dispensing the medication, making the retaining means tamper-evident means that the device cannot then be reused in an unauthorized manner. This helps to reduce the risk of the device being used with counterfeit products.

The retaining means can be provided in any suitable form. For example, the blister pack could engage in recesses in the device, or could be held in by locking bars or the like. However, it is preferred that the retaining means be in the form of a panel which fits over the base of the blister pack. This does not greatly increase the size of the device, and also ensures that the blister pack is retained across its entire surface, rather than just holding it at the ends.

In order to allow products to be removed, the panel may have rupturable regions, for example, in the same way as rupturable regions are normally provided in blister packs. However, for simplicity, it is preferred that apertures be provided in the panel to allow products to be removed from the blister pack in the open condition without removing the panel.

It is preferred that a blister pack is held by each of the first and the second members, to increase the overall storage capability of the device. Further, this allows products such as medication to be divided into groups, for example tablets to be taken in the morning and tablets to be taken in the evening.

The blisters of the blister pack can be accommodated by the device in any suitable way; for example, they can fit into recesses. However, it is preferred that at least one of said first and second members has apertures therethrough. This can allow access to the blisters to enable the products therein to be removed. For example, if a blister pack is sandwiched between a first or second member provided with apertures and a panel provided with aligned apertures, then the blister may be accessed from one side of the "sandwich" and the product pushed out from the other side.

If both of the first and second members have apertures therethrough, then it is preferred that the apertures are staggered such that the apertures in the first member and the second member do not overlie each other when the device is closed. If the apertures did overlie each other, and blister packs had only been put into (say) the first member, then it would be possible to remove tablets when the device was closed simply by pushing them out through the corresponding aperture in the second member. Having the apertures staggered avoids this problem, as the tablet would then come up against a solid part of the second member, rather than an aperture in it.

The device may have a peripheral wall to prevent a knife or similar implement being forced between the first and second members when the device is closed. This helps to prevent tampering with the device. Preferably, the wall extends outwardly of the device, transversely to the general plane of a blister pack to be held by the device. Thus, in use with outwardly facing blisters, the wall may extend higher than the blisters, and so prevent damage to said blisters. If the wall is lower than the blisters, then if the device is dropped it will land on the blisters, leading to damage to the blisters und possibly the tablets therein.

Preferably, the device comprises a child-resistant closure. Any suitable child-resistant closure can be used. However, in one preferred embodiment, the child-resistant closure has an actuating member for engagement by a user and provided on said first member, a locking portion operatively connected to said actuating member and adapted to engage with a corresponding locking portion provided on said second member, wherein in the closed condition of the device, the locking portions are on one side of the first and second members and the actuating member is on an opposite side. Positioning the locking portions and the actuating member on opposite sides of the device is intended to deter a child attempting to open the device, by rendering the manipulation required to open the device less obvious.

The actuating member can be formed in a number of ways, but is preferably generally "U"-shaped, one limb of the "U" being anchored on said first member and the locking portion being provided on the other limb of the "U".

It is preferred that the child-resistant closure has two spaced apart actuating members. It is then necessary to actuate both actuating members at the same time in order to open the device. The spacing between the actuating members can be made such that an adult's hand is large enough to actuate both actuating members with one hand, but a child's hand is too small to do this.

A shroud may be provided around the closure to prevent accidental operation. This can also serve to increase the child-resistance of the device, as the closure is then partly hidden, and so less obvious to an inquisitive child.

As an alternative form of child-resistant closure, the first and second members may both carry parts of a child-resistant closure, said parts being engaged by a further member to close said device. Preferably, this further member is a child-resistant screw cap or the like, and the first and second members both carry a portion of a neck to engage with said cap. Suitable child-resistant screw caps are readily available.

Preferably, the device additionally comprises means to retain said first and second members in a closed position when said child-resistant closure is released. This ensures that a separate motion, besides that necessary to disengage the child-resistant closure, is required. Even if a child were to discover the method of opening the child-resistant closure, the device would still not open unless a further step was taken.

According to a second aspect of the invention, there is provided a device for holding a blister pack, comprising first and second members relatively movable between an open condition in which products may be removed from a blister pack held by the device and a closed condition in which products may not be removed, and a child-resistant closure, wherein said child-resistant closure has an actuating member for engagement by a user and provided on said first member, and a locking portion operatively connected to said actuating member and adapted to engage with a corresponding locking portion provided on said second member, wherein in the closed position of the device, the locking portions are on one side of the first and second members and the actuating member is on an opposite side.

According to another aspect of the invention, there is provided a device for holding a blister pack, comprising first and second members relatively movable between an open condition in which products may be removed from a blister pack held by the device and a closed condition in which products may not be removed, and a child-resistant closure, wherein said first and second members both carry parts of said child-resistant closure, said parts being engaged by a further member to close said device.

According to a further aspect of the present invention, there is provided a device for holding a blister pack containing products, the device being able to adopt an open condition in which products are removable from the blister pack and a closed condition in which removal of the products is prevented, and the device having a plurality of apertures for exposing respective blisters of the blister pack to the outside when the device is in both the closed and the open conditions, whereby when the device is in the open condition the blisters may be pushed from the outside to remove the products.

With such an arrangement a user can easily see the blisters, and thus identify the products which have already been removed, without opening the device. At the same time, whilst the device remains closed, the products are prevented from removal. Once the device is opened, products may be removed. Preferably, the device is held closed by a child-resistant closure. The device may optionally be provided with the other advantageous features described herein.

The device of the present invention is particularly intended for use with relatively small products. Generally, in blister packs, the size and shape of the blister is very similar to that of the product.

However, for small products, the blister may be difficult for a user to deform, particularly because of the difficulty in bending a low height peripheral blister wall by pressure applied to the top, as is required when crushing a blister. In addition, if the dimensions of the blister as viewed in plan are small, then the upper wall of the blister only spans a small distance within the peripheral wall and is thus relatively rigid. As a result, the finger of the person attempting to dispense the tablet, being soft, tends to be compressed itself, rather than crushing the blister. This makes the product difficult to dispense.

According to a further aspect of the present invention, there is provided a blister pack having at least one blister for accommodating a product therein, said blister extending upwards from a base to an upper surface, the blister being shaped such that a part of said blister projects into the interior of the blister below the upper surface, said projecting part serving to contact the product when the blister is depressed by a force applied to the blister, and thus transmit force to said product.

By providing a projecting part to act on the product, reliable dispensation of the product can be achieved even if the blister overall is larger than the product. By making a blister larger, deformation of the blister is generally easier for the reasons explained above. A larger blister is also advantageous during the operation of filling a blister pack with products.

The inwardly projecting part of the blister may be formed as a depression in the upper surface of the blister. The lowermost part of the depression can then act on the product when the blister is compressed. Advantageously, the depression is positioned centrally of the blister so as to contact the centre of a product to be pushed out.

Preferably, the blister has two main faces which meet in an upper region of said blister, said depression being formed in the upper region. The depression can be formed to be generally more rigid than the main faces, so that it tends to retain its shape while the main faces collapse.

Preferably, the upper region is generally elongate. In use, a major axis of the product is parallel to said elongate upper region.

As an alternative, the inwardly projecting part of said blister is formed as a circumferential ledge extending around said blister. This then acts along the circumference of the product when the blister is compressed. Preferably, further ledges are formed along the height of said blister. These allow the blister to collapse in a concertina fashion, ensuring that the product is pushed out.

The invention also extends to apparatus for making blisters for blister packs as described above. Apparatus for making blister packs is of course known, but would be modified in accordance with the required shape of the blisters.

BRIEF DESCRIPTION OF THE DRAWING FIGURES

Preferred embodiments of the invention will now be described by way of example only and with reference to the accompanying drawings, in which:

FIG. 2 shows a perspective top view of a tray of the first embodiment of the device, being folded into its closed condition;

FIG. 6 is a further enlarged view of the latch;

DETAILED DESCRIPTION OF A PREFERRED EMBODIMENT

Figure 1:
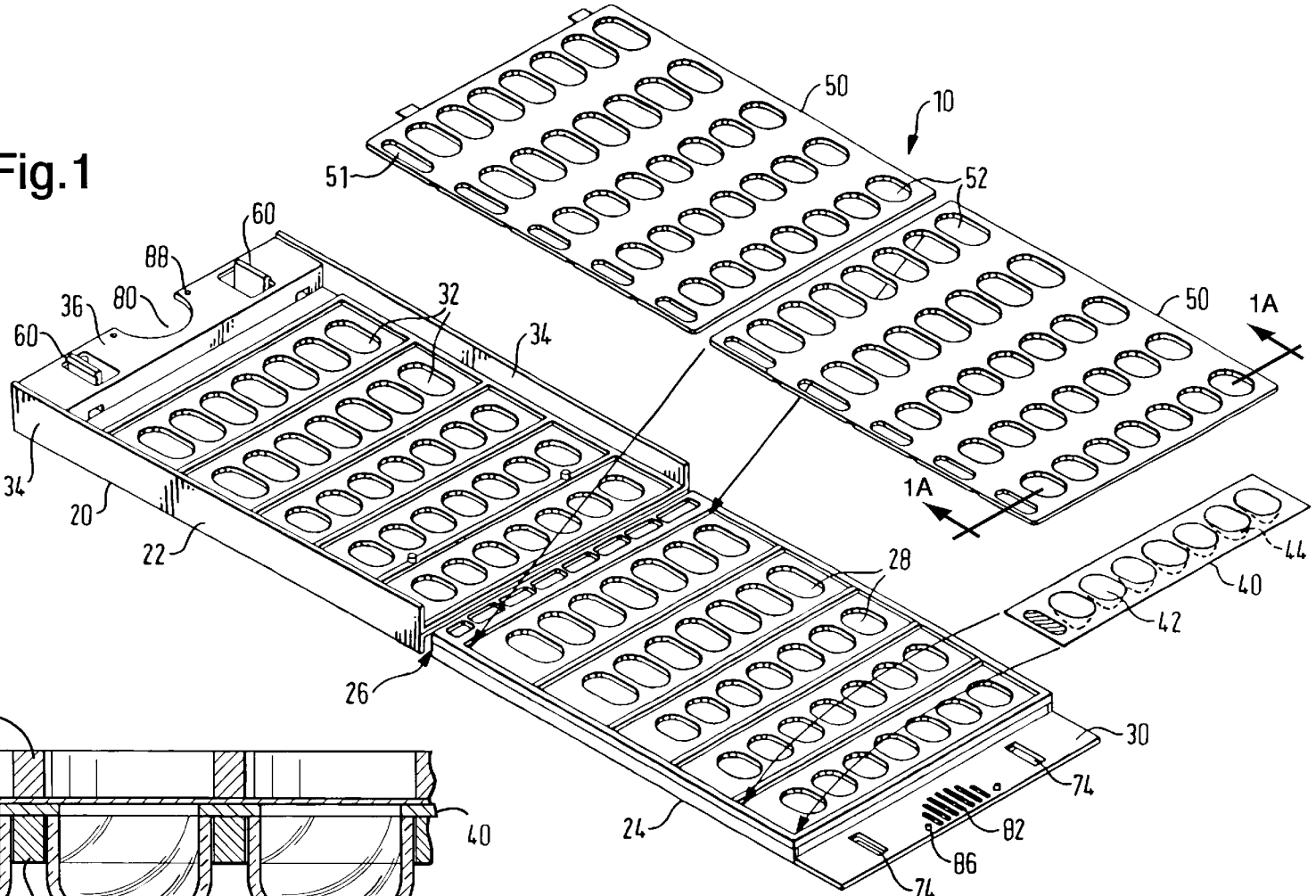
FIG. 1 shows an exploded perspective view of a first embodiment of the device according to the invention, split into its various components.
Figure 1A:
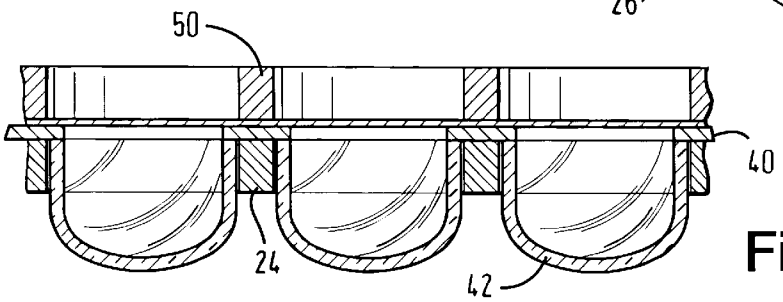
FIG. 1A is a cross-sectional view taken generally about one line 1A—1A in FIG. 1 in an assembled but open position of the device illustrating the retention of the blister pack with its blisters projecting to the outside of the device.

A first embodiment of the device of the invention is shown generally in FIG. 1, and is denoted by the reference numeral 10. The device 10 comprises a hinged tray 20, and panels 50 which retain blister packs 40 in place. The device is able to hold a number of blister packs 40 (only one of which is shown in FIG. 1), in the form of blister strips.

The tray 20 comprises a base 22 and a lid 24, connected by means of a hinge 26. The lid 24 is formed as a flat plate with a number of apertures 28 formed therethrough. At the end of the plate distant from the hinge is a planar region 30. The base 22 is also formed as a flat plate with a number of apertures 32 formed therethrough, and has upstanding rim walls 34 formed along the three non-hinged edges. These rim walls 34 extend upwardly and downwardly relative to the plate. At the end of the plate distant from the hinge, a generally planar region 36 is formed, extending between the rim walls 34.

Figure 3:
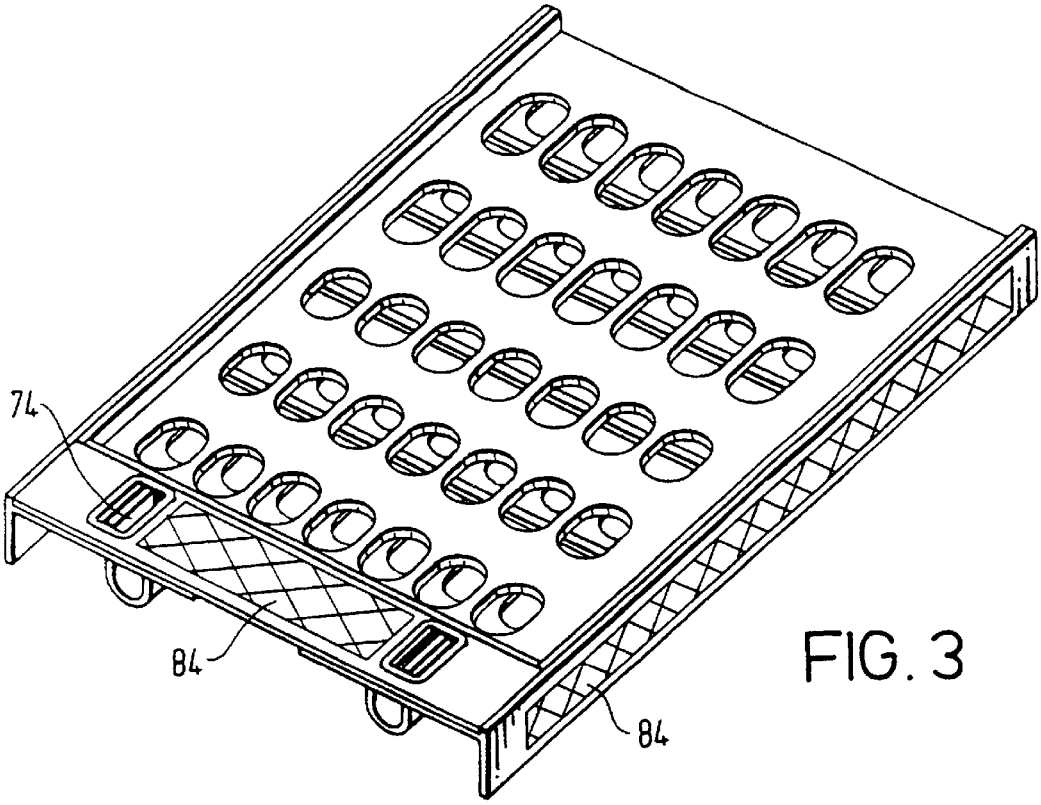
FIG. 3 shows a perspective top view of the tray of the first embodiment of the device in its closed condition.
Figure 4:
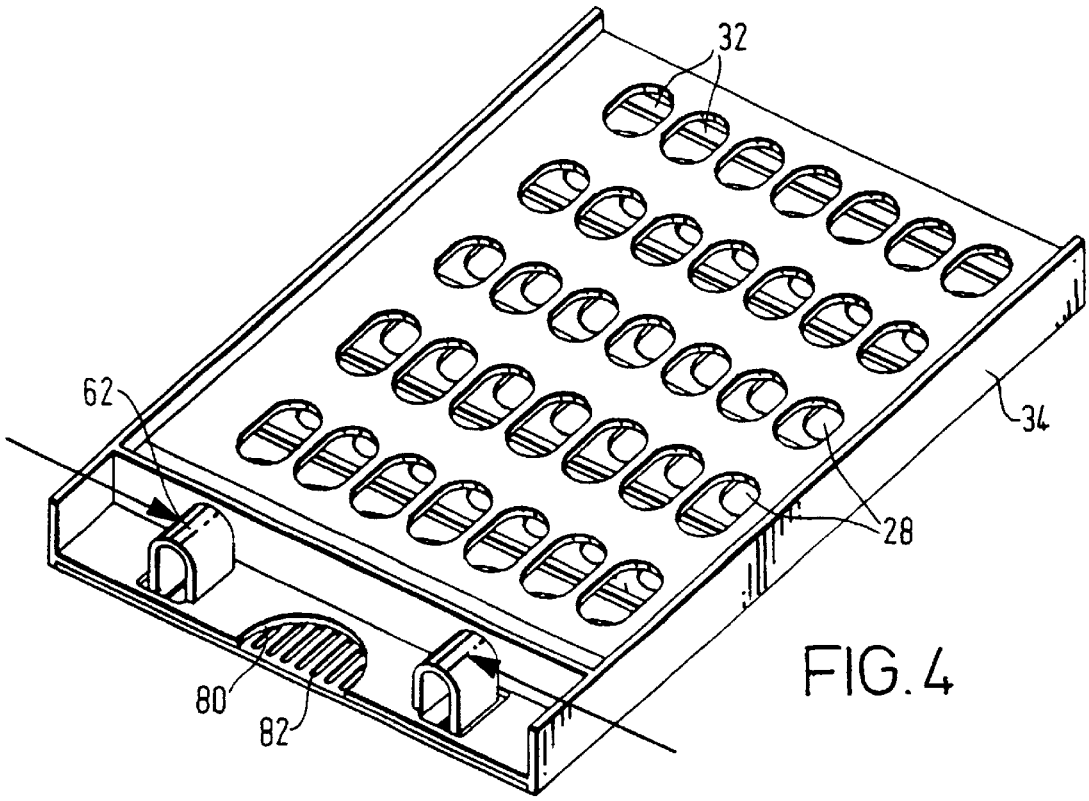
FIG. 4 shows a perspective underside view of the tray of the first embodiment of the device in its closed condition.

The tray 20 can be opened out so that the lid 24 and base 22 are generally co-planar (as in FIG. 1). The lid 24 can also be pivoted about the hinge 26 to overlie the base 22 (as shown in FIGS. 3 and 4), in which position inner faces of the lid 24 and base 22 confront each other, and outer faces of the lid and base form the outer surface of the device 10. The base 22 and lid 24 can be retained in this folded position by means of a child-resistant closure 60. Because of the rim walls 34 which extend upwardly and downwardly from the base, it is not possible to open the tray by inserting a knife or similar thin article between the lid and the base, as the gap between them is shielded by the wall in this closed position.

The apertures 28, 32 formed in the base 22 and lid 24 are of a size and shape to receive the blisters 42 of blister packs 40. To assemble the device 10 into a package, the tray 20 is opened out, as shown in FIG. 1, and blister packs 40 are inserted into the tray 20 with their blisters 42 facing downwards and their backing sheets 44 overlying the inner faces of the base and/or lid. In this position, the packs 40 are retained by gravity. The number of blister packs 40 used can vary, depending (in the case of medicinal products) on the course of medication required. The height of the blisters 42 relative to their backing sheet 44 should be such that the blisters 42 do not project above the rim walls 34, in order to reduce the risk of accidental damage to the blisters 42.

Once the blister packs 40 have been inserted, the panels 50 are placed over them. The panels 50 are in the form of flat plates, and also have apertures 52 therethrough, corresponding in shape, size and position to those in the base 22 and the lid 24 of the tray. The panels 50 may also have other apertures 51, through which information and the like on the backing sheet 44 of the blister packs 40 can be read.

The purpose of the panels 50 is to retain the blister packs 40 in place. The backing sheet 44 of each pack 40 is retained between the base 22 or lid 24 and the panel 50. The apertures 52 in the panel 50 allow the tablets contained in the blister packs 40 to be pushed out through the panel 50 while still retaining the blister pack 40 itself in place.

The panels 50 can be snapped into place on the base 22 and the lid 24 by means of a snap-fitting engagement, in such a way as to prevent their removal during normal use. While it would be possible to remove the panels, for example for the purposes of refilling the device with blister packs, such removal would normally require the use of a tool of some sort, and would damage or break the panels and ensure that they could not be reused, affording a certain degree of tamper evidence.

It is envisaged that the tray 20 will be filled with blister packs 40 by the pharmacist dispensing the tablets, who will then snap the panels into place over the blister packs, and so the degree of tamper evidence afforded by the snap-fitting of the panels 50 helps to prevent any unauthorized changing of the tablets. In addition, the fact that the panels are damaged on removal helps to prevent the reuse of trays with other blister packs, and so can reduce the chance of counterfeiting. However, in circumstances where it is desired to make the device reusable, for example because of environmental legislation, the panels can be removably secured to the tray.

Blister packs 40 can be inserted into both the base 22 and the lid 24, or just one of them. If the blister packs 40 are inserted into both, then when the tray 20 is folded shut, the backing sheets 44 of the blister packs 40 will face each other, making it impossible to dispense any of the tablets while the tray is closed.

If blister packs 40 are only inserted into the base 22, then there is a risk that tablets could be pushed out of the device 10, through the apertures 28 in the lid 24, while the tray 20 is closed, which defeats the object of putting a child-resistant closure 60 on the tray 20 to prevent it being opened. A similar risk occurs when the blister packs 40 are only inserted into the lid 24. To prevent the tablets being pushed out of the blister packs 40 in this way, the apertures 28, 32 in the base 22 and the lid 24 are arranged such that they are out of register when the tray 20 is closed, as can be seen in FIGS. 3 and 4. Any attempt to push the tablets out is then thwarted, as the tablets abut against the body of the base or lid, rather than passing through the apertures.

This staggering of the apertures can be achieved by varying their spacing, or (as in the embodiment illustrated) by having some apertures of different sizes. Whichever method is used, it is a preferred feature that the arrangement of the apertures on the base and the lid is the same in plan view, as this allows the panels used with the base and the lid to have the same arrangement of apertures. As a result of this, the panels for the base and the lid can be made the same.

As a further precaution against tablets being pushed out of the device when it is closed, any apertures in the base and the lid which are not being used to accommodate blisters can be closed off, for example by empty blister packs or strips of card therein.

In the embodiment shown, the number of apertures 28, 32 in the base 22 and the lid 24 is the same, although different numbers can be used. The apertures 28, 32 are arranged in a 5×7 grid, and it is intended that each of the seven columns will accommodate the tablets to be taken on a particular day of the week. Further, the base 22 and the lid 24 can be used to separately store tablets to be taken in the morning and afternoon.

Figure 5:
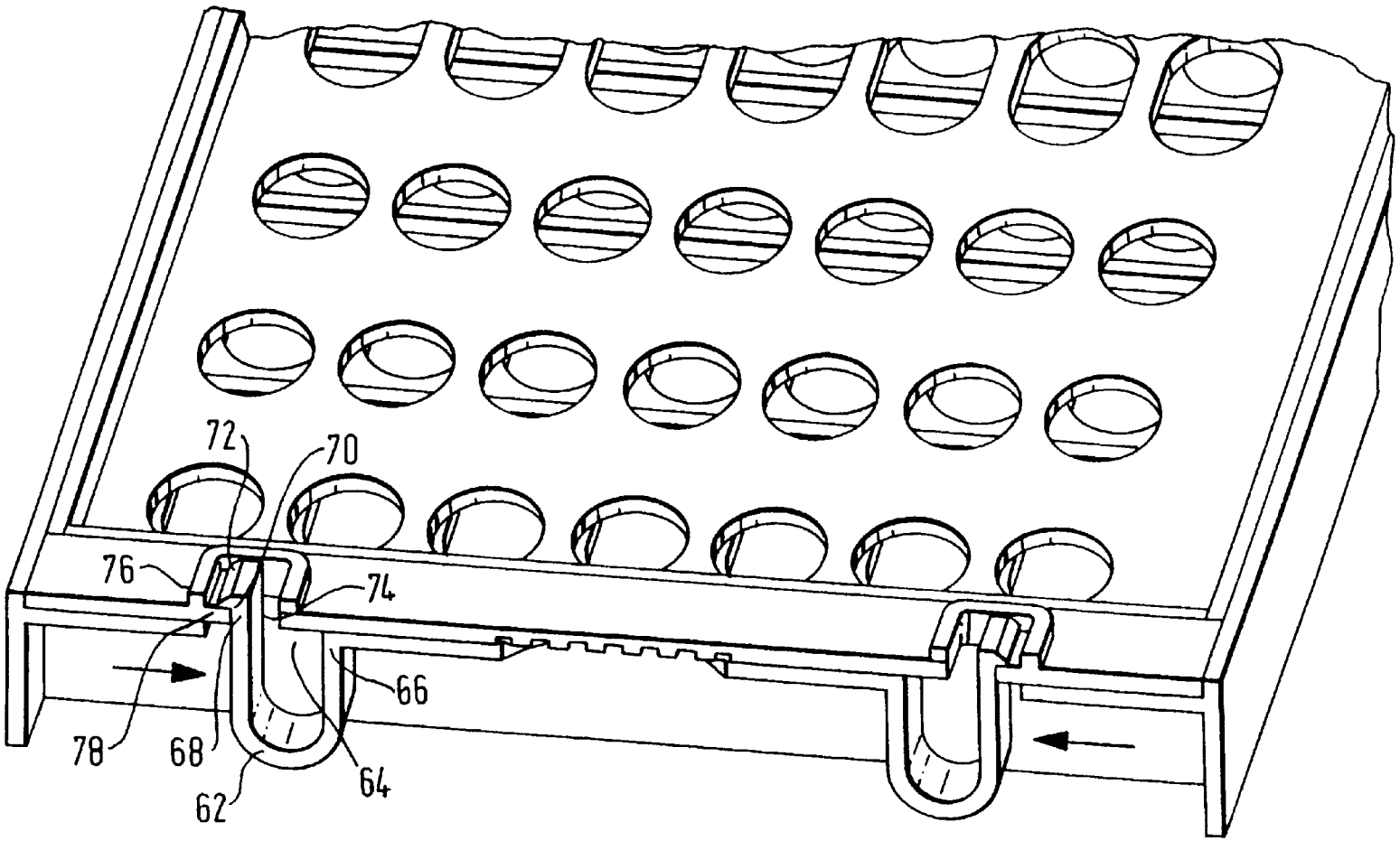
FIG. 5 shows an enlarged view of a latch of the tray.

The child-resistant closure 60 is shown in more detail in FIGS. 5 and 6. As can be seen from these Figures, two latches are provided on the planar portion 36 of the base 22 distant from the hinge, each in the form of a resilient clip 62. The clips 62 are adapted to engage with openings 74 in the planar portion 30 of the lid 24 distant from the hinge.

Each clip 62 is formed in conjunction with an opening 64 in the planar portion 36 of the base 22. The clip 62 is formed as a U-shaped member, with the end 66 of one limb connected to one side of the opening 64 and extending generally perpendicular to the planar portion 36. The end 68 of the other limb is free, and extends through the opening 64. This end has a projection 70 on it, and the face of the projection 70 distant from the planar portion of the base has a chamfered region 72.

The projection 70 is adapted to engage with an opening 74 in the planar portion 30 of the lid 24. This opening 74 is best shown in FIG. 5. As can be seen, the opening 74 has a small upstanding wall 76 surrounding it, the wall 76 projecting away from the base 22 when the tray 20 is closed. The height of the wall 76 is such that the end of the clip 62 which extends through the opening 74 does not project above the wall 76.

A projection 78 extends away from the inner end of the wall 76 towards the clip 62, and this projection 78 engages with the projection 70 on the end 68 of the limb of the clip 62. It is this engagement that holds the tray closed.

The engagement of the clip 62 will now be described. During closure of the tray 20, the inner faces of the base 22 and the lid 24 approach each other as the lid 24 rotates around the hinge 26. In particular, the inner face of the projection 78 on the lid approaches the free end 68 of the clip 62. The clip 62 and the projection 78 are arranged such that the projection 78 contacts the chamfered portion 72 of the projection 70 on the clip 62. As a result of the chamfer 72, and the resilient flexibility of the clip 62, the limbs of the U are pushed together, and this displaces the projection 70 on the free end 68 of the clip 72 to such an extent that the projection 78 can pass it. Once the projection 78 has passed the projection 70 on the clip 62, the clip springs back to its original position, so that the projection 70 on the clip 62 overlies the lid projection 78.

As mentioned above, this engagement of the projections 70, 78 holds the lid 22 and the base 24 in a closed position. The only way to access the tablets in the blister packs 40 is to release the engaging projections, open the tray, and push the tablets out through the apertures in the panels. To aid the opening of the tray, the planar portion 36 of the base 22 is provided with a cut-out 80, and the planar portion 30 of the lid 24 has a finger grip portion 82 which overlies the cut-out 80 when the tray 20 is closed.

Clearly, in order to release the engaging projections 70, 78, it is necessary to move the projection 70 at the end of the clip 62. However, because of the upstanding wall 76 surrounding the opening 74 in the planar portion 30 of the lid 24, it is very difficult to manipulate the projection 70 on the clip 62 directly. While it may be possible to accomplish this using some sort of tool, this is awkward, and it is unlikely that a child would do it accidentally.

To move the projection 70 at the end of the clip 62, it is necessary to squeeze the limbs of the U together, as indicated by the arrows in FIGS. 4 and 5. As the limb without the projection is fixed to the base 22, this has the effect of pulling the projection 70 on the free end of the U away from the projection 78 on the lid 24, and so release the engagement. This is shown schematically in FIG. 6.

Although the manoeuvre required to disengage the clip 62 is quite straightforward, it is considered unlikely that a child, attempting to open the package 10, would come across the correct method. A child would attempt to open the package 10 in the obvious way, by concentrating on the engaging projections. However, it is very difficult to disengage the projections by direct manipulation of the projection 78 on the clip 62, because it is "shrouded" by the upstanding wall 76.

The difficulty for children can be further increased by providing a further wall, perpendicular to the planar portion of the base 36 and the rim walls 34, although such a wall is not present in the embodiment shown. Providing this wall means that the clip 62 is effectively "hidden", and so there is even less chance that a child would strike on the necessary opening procedure by accident. Further, it reduces the chance of inadvertently opening the tray 20 when this is not desired.

There are two clips 62, and thus two sets of engaging projections, both of which need to be disengaged in order to allow the tray 20 to be opened. It is therefore necessary to manipulate both clips 62 simultaneously to open the device. The spacing of the clips is such that they can be manipulated simultaneously using one hand by an adult, by squeezing both of the free ends of the U's together. However, the spacing, for example about 60 mm, is such that a child's hand is generally not large enough to do this. The adult then uses their other hand to lift the lid by means of the finger grip portion 82. While this is relatively straightforward for an adult, it is not easy for a child.

A further advantageous aspect of the device using the clips is that the entire tray can be moulded from a plastics material in one piece using a simple two-piece mould. The tray is moulded in its open position, and the position of the various apertures with regard to the projections and the clip obviate the need to use undercuts or cores in the mould.

However, as the tray is moulded in its open position, there is a problem in that the tray then has a tendency to "spring back" to its original as-moulded position. As a result, the tray will spring open as soon as the projections are disengaged. Since the point of providing the two clips is to ensure that two hands are needed to open the device, one to disengage the clips and one to lift the lid, this "spring back" will reduce the child-resistance of the device.

To overcome this, the base and the lid are provided with means to hold the device closed even after the child-resistant closure has been opened. These means hold the device closed with a relatively small force, and so the device is still easy to open for an adult, but improves the child-resistance of the device as a whole. The means can be, for example, a pin on one of the base and the lid engaging in a hole provided on the other of the base or lid. Such a pin and hole are shown in FIG. 1, denoted by the reference numerals 86 and 88.

As shown in FIG. 3, flat areas 84 of the device 10, such as the rim walls 34 and the outer face of the planar portion 36 of the base 22, can have labels applied to them. These labels can carry information about the tablets in the device 10, about the times and order in which the tablets are to be taken, or any other information. Information, in particular with regard to the times and order in which the tablets are to be taken, can also be displayed on the panels 50.

Although the tray 20 is shown with the base 22 and lid 24 hinged about one of their shorter walls, the hinge 26 could be formed along one of the longer walls. In addition, there is no need for the base 22 and the lid 24 to be rectangular, and they can be of any shape. In addition, although the tray 20 is shown with two clips 62, more or fewer could be used.

It is also possible to have the panels hinged to the base and the lid, rather than being entirely separate parts. In this case, the panels would again engage with the base and the lid in such a way as to allow them to removed without damaging them, to enable the pack to be refilled.

The embodiment described above works well in practice. However, it will be seen that in order to dispense tablets from the blister packs, it is necessary to exert a force which tends to push the blister packs away from the base and the lid and towards the panels. As a result, the means holding the panels onto the base and the lid need to hold the panels very securely, and this can lead to difficulties e.g. for the pharmacist filling the pack, in that the snap fitting force may have to be relatively large, or a large number of snap fits may be needed.

Figure 7:
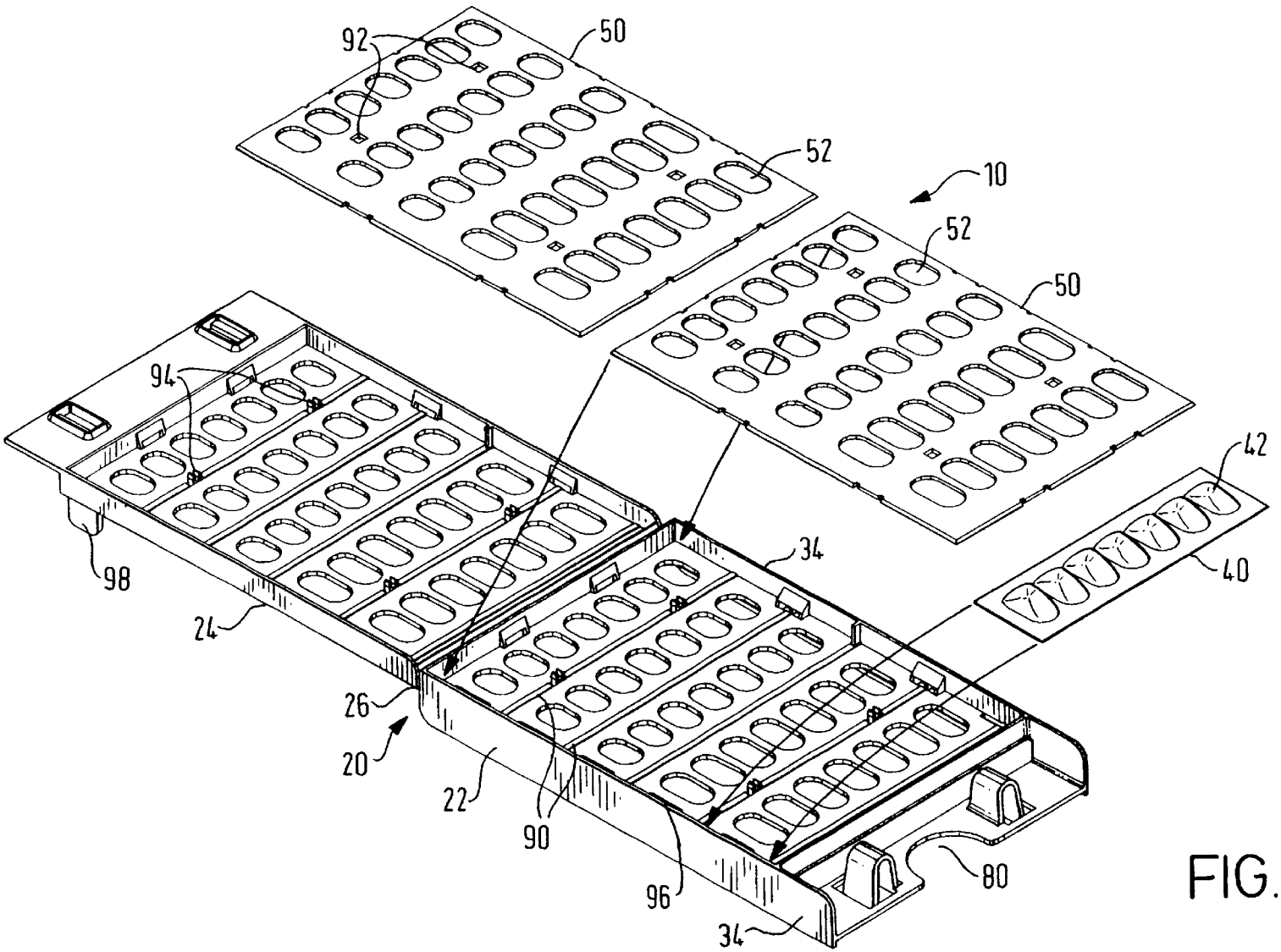
FIG. 7 shows an alternative arrangement for holding the blister packs in place.

Accordingly, in a second embodiment shown in FIG. 7, the arrangement for retaining the blister packs is somewhat different. Corresponding parts of the device of this embodiment are denoted by the same reference numerals as in the first embodiment.

Rather than the packs being inserted into the tray so that the blisters project downwards through the holes, the blister packs are placed on the tray, with the blisters projecting upwardly, away from the holes, and between positioning ribs 90. It should be pointed out that the tray in FIG. 7 is inverted relative to the one shown in FIG. 1. When the packs have been inserted, panels are then laid over the packs, and apertures 92 in the panels engage with snap-fittings 94 on the tray.

As a result of the different layout, when a tablet is being dispensed, the blister pack 40 is pushed towards the tray 20, rather than away from it. The dispensing force does not tend to push the panel 50 away from the tray. Thus the attachment of the panel 50 to the tray does not need to be designed to be excessively strong simply to resist the dispensing force.

Further, due to the different layout, apertures 96 can be provided in the base and the lid, rather than the panels, for viewing of batch information and the like printed on the foils of the blister packs. These apertures 96 are almost hidden by side walls 34 in FIG. 7.

The lid of the tray of this embodiment is preferably formed with support legs 98. These allow the flat plates of the base 22 and the lid 24 to rest in the same plane while the tray is being filled by the pharmacist, as the lid is supported by the legs 98 and the base is supported by the rim walls 34. Further, when tablets are being dispensed from the tray, the tray can be opened out and positioned with the blisters facing upwards, and the tablets dispensed by downward pressure, so that they fall into the region beneath the flat plates. This can make removal of the tablets easier, especially for the sick or infirm.

The support legs 98 fit into slots in the base (not shown). In a further preferred feature, the legs and slots engage with each other to provide the said means for holding the device closed even after the child-resistant closures have been opened.

Figure 8:
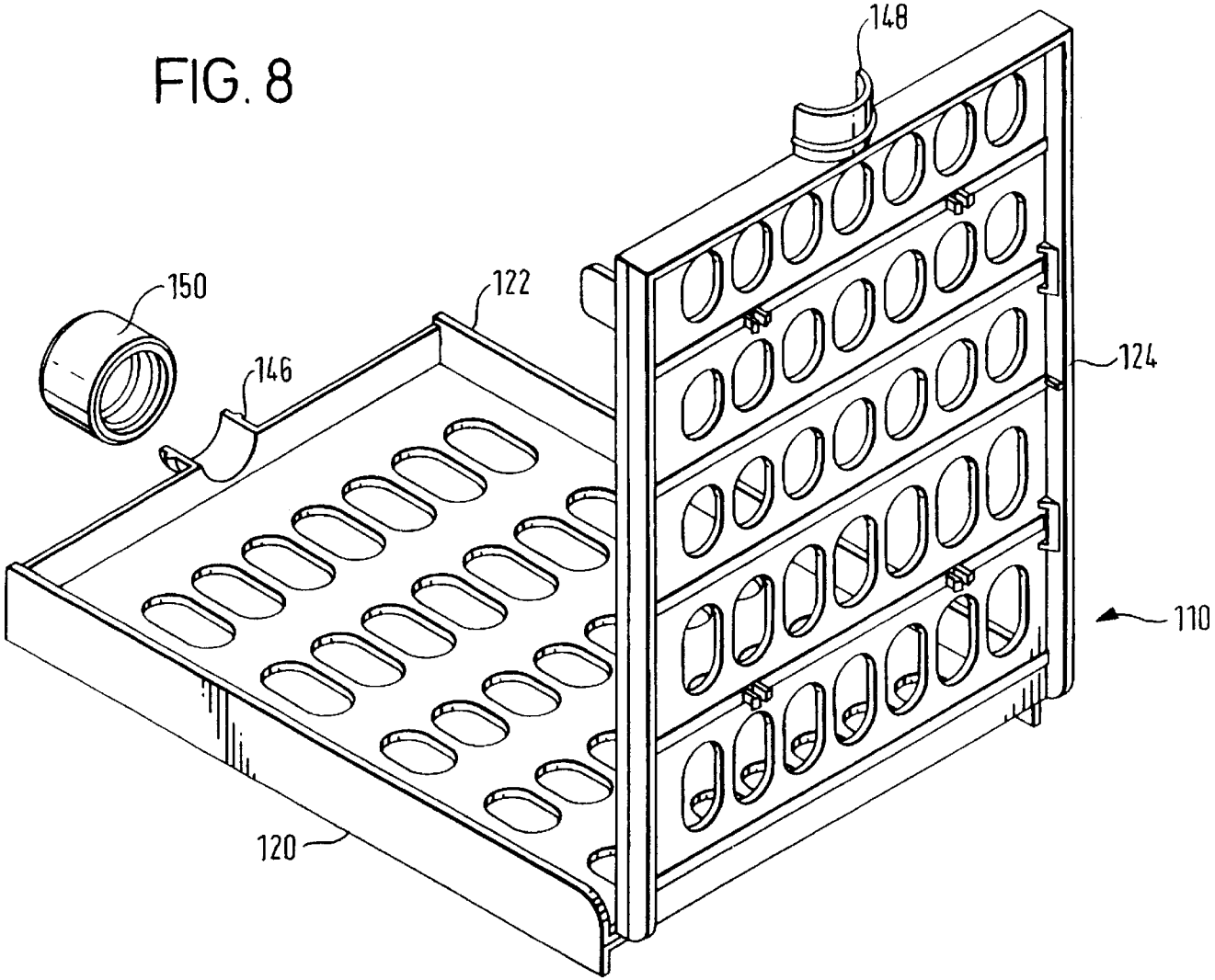
FIG. 8 shows an alternative closure arrangement.
Figure 9:
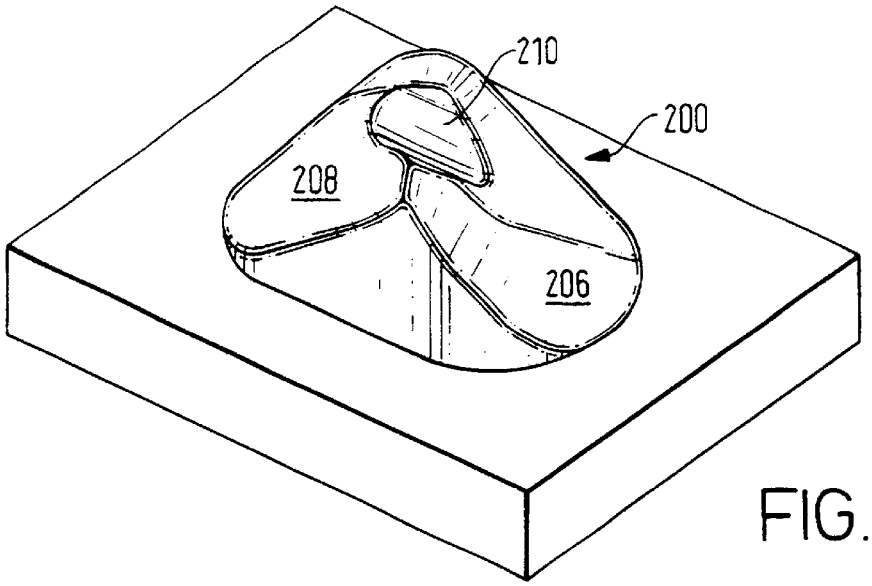
FIG. 9 is a perspective view of a blister for a blister pack.
Figure 10:
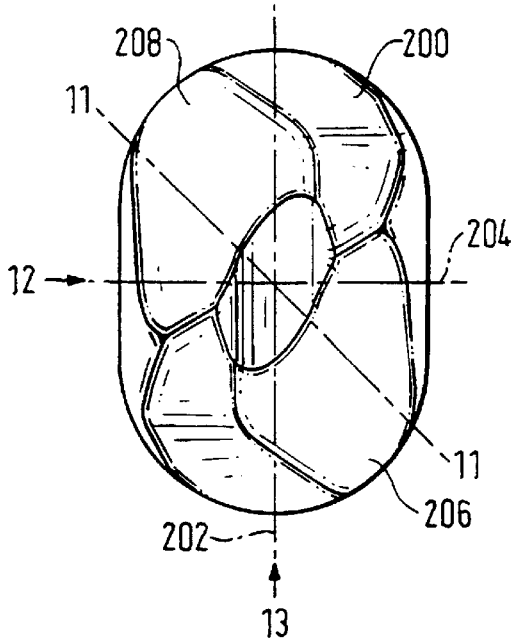
FIG. 10 is a plan view of the blister of FIG. 9.
Figure 11:
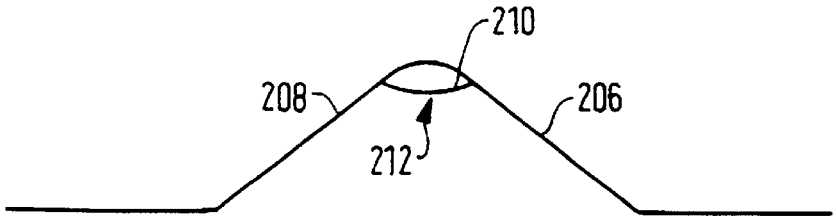
FIG. 11 is a section along line 11–11 in FIG. 10.
Figure 12:
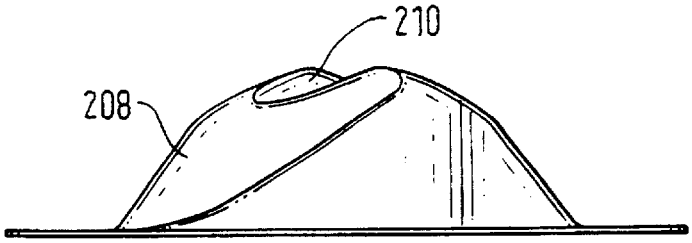
FIG. 12 is a view along arrow 12 in FIG. 10.
Figure 13:
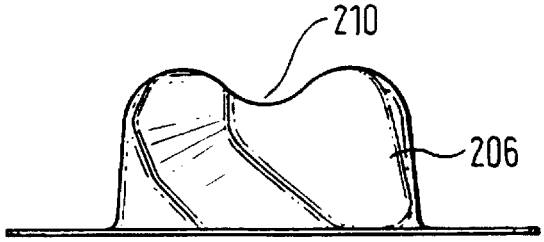
FIG. 13 is a view along arrow 13 in FIG. 10.
Figure 14:
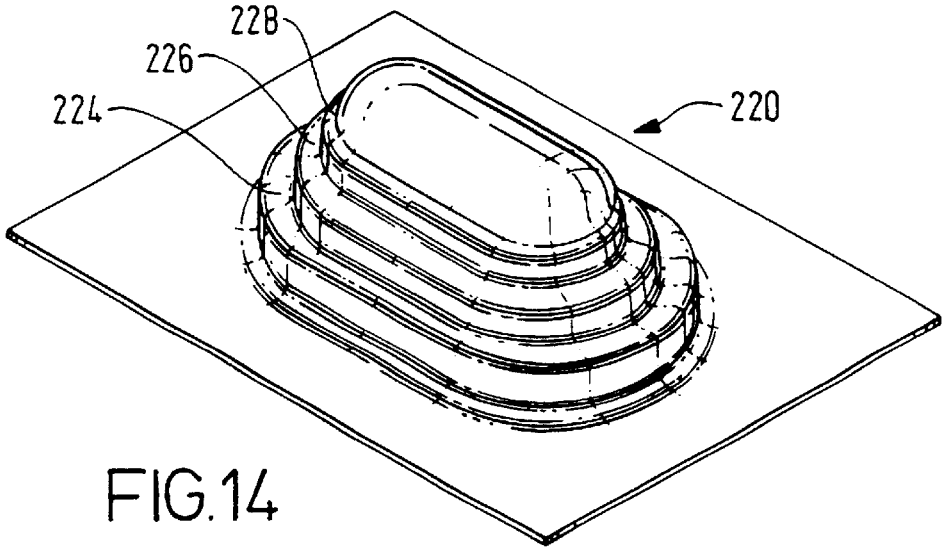
FIG. 14 is a perspective view of another blister for a blister pack.
Figure 15:
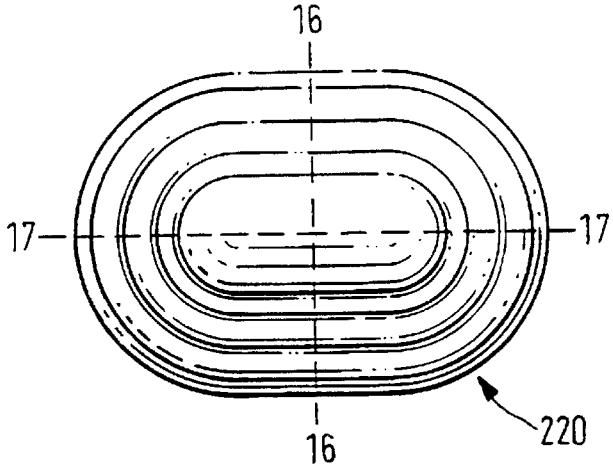
FIG. 15 is a plan view of the blister of FIG. 14.

A further embodiment, having a different child-resistant closure, is shown in FIG. 8.

The device 110 of the further embodiment is generally similar to that shown in FIG. 7, in that it comprises a tray 120 formed from a hingedly connected base 122 and lid 124, and so will not be described in great detail. However, rather than the child-resistant closure being formed as two U-shaped clips, the child-resistant closure used in this embodiment is similar to those used on bleach bottles and the like, in which a cap engages with the neck of the bottle. In one version, protrusions on the neck engage with lugs on the inside of the cap, and this engagement normally prevents the cap from rotating on the neck. To disengage the protrusions and the lugs, it is necessary to squeeze the cap at opposite sides thereof. As a result, the parts of the cap which are 90° away from the parts which are being squeezed are deformed outwardly, and this outward deformation serves to disengage the lugs and the protrusions.

In this embodiment, both the base 122 and the lid 124 carry a half 146, 148 of the neck, each with a protrusion thereon. When the base and lid are folded closed, the halves meet and form an entire neck. The child-resistant cap 150 can then be put onto the neck to hold the device closed.

As an alternative to the child-resistant closure described above with reference to FIG. 8, the halves of the neck can be formed with normal screw threads, and the cap can be a child-resistant cap of the type usually used on pill bottles.

Of course, any other suitable form of child-resistant closure can be used to hold the device closed. The clip of the first and second embodiments has the advantage that it always requires the same force to open it. The force required to open a child-resistant screw cap can vary, according to the force originally used to screw it up, but the clip always requires the same amount of force, irrespective of how it was closed. The force required can be tailored to, for example, people with arthritis so that they will not have difficulty in opening the device.

The trays described herein are intended to be used with a particular drug, whose dose varies from 1 mg to 2.75 mg depending on the body mass of the patient. To avoid production of a very large number of tablets of differing sizes, the drug is dispensed in 1 mg and 0.25 mg tablets. The various doses can thus be made up from a number of large or small tablets. It will be seen that the trays described above have two large and three small apertures in each of the seven columns, thus allowing a maximum dispensed dose of 2×1 mg+3×0.25 mg, or 2.75 mg. Differing numbers of blister packs can be dispensed by the pharmacist using the same tray to make up the prescribed dose. A week's course of tablets (morning and afternoon) can be stored in each tray.

The 0.25 mg tablet is relatively small. The problems regarding small tablets in blister packs have already been discussed, in particular with regard to the difficulties involved in removing the tablets from the packs. A first blister for use with a blister pack and designed to overcome these problems is illustrated in FIGS. 9 to 13.

The blister 200 is generally oval in plan view, with a major axis 202 and a minor axis 204. The blister comprises two main faces 206, 208 and a number of minor faces, which incline upwards from the base at a relatively shallow angle. The main faces 206, 208 meet in an upper region of the blister, along a line which is, in plan view, at an angle to the major and minor axes. Midway along the meeting line, at the centre of the surface of the blister, is formed a depression or dimple 210, which projects into the body of the blister.

The blister and tablet are sized such that the tablets lies parallel to the meeting line when the blister is filled. As a result, the blister in plan view is considerably larger than the tablet, which renders the blister pack easier to fill. Further, the distance between the base of the blister and the lowermost point 212 of the inwardly-projecting dimple 210 is only slightly more than the thickness of the tablet. Thus, the dimple projects downwardly into the blister almost as far as the upper surface of the tablet.

A person wishing to dispense the tablet pushes down with a finger or thumb on the blister. As the meeting line of the two main faces 206, 208 is the highest point of the blister 200, this will be contacted by the finger and pressed down. The meeting line and the dimple 210 formed in the middle thereof have a degree of structural rigidity, and so they tend to move down as a whole. As a result, the lowermost point 212 of the dimple 210 contacts the upper surface of the tablet after the person has depressed the top of the blister a very small distance.

Subsequent force pushes the tablet against the foil, and eventually through it. Continued application of force on the blister as the tablet passes through the foil tends to crumple the blister. However, even during this crumpling, the meeting line and the dimple 210 tend to retain their shape. The tablet thus continues to be pushed downwards by the lowermost point 212 of the dimple 210, even as the blister 200 is crushed, and this further aids removal of the tablet.

Turning now to FIGS. 14 to 17, these show an alternative blister for use with a blister pack. Again, the blister 220 is generally oval in plan view. The sides of the blister slope upwardly from the plane of the foil, toward a central ridge 222. However, rather than being smooth slopes, the sides of the blister are stepped in the manner of a ziggurat.

Figure 16:
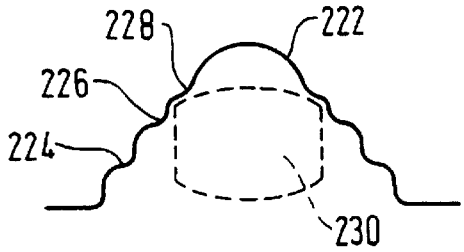
FIG. 16 is a section along line 16–16 in FIG. 14.
Figure 17:
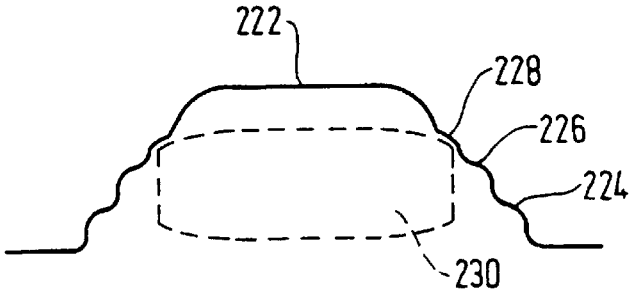
FIG. 17 is a section along line 17–17 in FIG. 14.

As a result of these steps, there are defined a series of ledges 224, 226, 228 running around the circumference of the blister. The ledges are sized relative to the tablet to be retained in the blister so that the topmost ledge 228 is spaced very slightly above the edge of the tablet 230, which lies along the major axis of the blister, as best shown in FIGS. 16 and 17.

When the person wishing to dispense the tablet pushes down with a finger or thumb on the central ridge 222 of the blister 220, the topmost ledge 228 contacts the edge of the tablet 230. The force exerted by the person is thus transmitted directly to the tablet 230 after the person has depressed the top of the blister a very small distance.

Subsequent force pushes the tablet 230 against the foil, and eventually through it. Continued application of force on the blister 220 as the tablet passes through the foil will tend to crumple the blister along the ledges 224, 226, 228, so that it concertinas, further helping the removal of the tablet.

Thus, a blister which is higher and wider than the tablet it retains can be provided, while still allowing the tablet to be dispensed from the blister without difficulty.

Although the invention has been described in the context of a device for holding blister packs of medicinal tablets, it will be appreciated that it can be used to hold blister packs of any sort.

What is claimed is:

1. A device for holding a blister pack having a base and deformable blisters projecting from the base for containing products, comprising first and second members operable between an open condition in which products may be removed from blisters of the blister pack held by the device and a closed condition in which products may not be removed, the device also comprising retaining means for the blister pack allowing products to be removed from the blisters of the blister pack when the device is open, the retaining means preventing the blister pack from being removable from the device, and the device having a plurality of apertures for exposing respective blisters of the blister pack to the outside of the device when the device is in both the closed and the open conditions, whereby when the device is in the open condition the deformable blisters may be pushed and deformed from the outside of the device to remove the products.

2. A device as claimed in claim 1, wherein the retaining means are tamper-evident.

3. A device as claimed in claim 1, wherein the retaining means are in the form of a panel which fits over the base of the blister pack.

4. A device as claimed in claim 3, wherein apertures are provided in the panel to allow products to be removed from the blisters of the blister pack in the open condition without removing the panel.

5. A device as claimed in claim 1, wherein a blister pack is held by each of the first and the second members.

6. A device as claimed in claim 1, wherein at least one of said first and second members has apertures therethrough.

7. A device as claimed in claim 6, wherein the apertures are provided in both said first and second members, the apertures being staggered such that the apertures in the first member and the second member do not overlie each other when the device is closed.

8. A device as claimed in claim 1, additionally comprising a peripheral wall.

9. A device as claimed in claim 8, wherein the wall extends outwardly of the device, transversely to the general plane of a blister pack to be held by the device, higher than the blisters.

10. A device as claimed in claim 1, additionally comprising a child-resistant closure.

11. A device as claimed in claim 10, wherein the child-resistant closure has an actuating member for engagement by a user and provided on said first member, and a locking portion operatively connected to said actuating member and adapted to engage with a corresponding locking portion provided on said second member, wherein in the closed condition of the device, the locking portions are on one side of the first and second members and the actuating member is on an opposite side.

12. A device as claimed in claim 11, wherein the actuating member is preferably generally "U" -shaped, one limb of the "U" being anchored on said first member and the locking portion being provided on the other limb of the "U".

13. A device as claimed in claim 11, wherein the child-resistant closure has two spaced apart actuating members.

14. A device as claimed in claim 11 wherein a shroud is provided around the closure.

15. A device as claimed in claim 10, wherein the first and second members both carry parts of a child-resistant closure, said parts being engaged by a further member to close said device.

16. A device as claimed in claim 15, wherein said further member is a child-resistant screw cap, and the first and second members both carry a portion of a neck to engage with said cap.

17. A device as claimed in claim 10 wherein the device additionally comprises means to retain said first and second members in a closed position when said child-resistant closure is released.

18. A device for holding a blister pack having a base and blisters projecting from the base, comprising first and second members relatively movable between an open condition in which products may be removed from blisters of the blister pack held by the device and a closed condition in which products may not be removed from the blisters of the blister pack, and a child-resistant closure, wherein said child-resistant closure has an actuating member for engagement by a user and provided on said first member, and a locking portion operatively connected to said actuating member and adapted to engage with a corresponding locking portion provided on said second member, wherein in the closed position of the device, the locking portions are on one side of the first and second members and the actuating member is on an opposite side.

19. A device for holding a blister pack, comprising first and second members relatively movable between an open condition in which products may be removed from the blisters of the blister pack held by the device and a closed condition in which products may not be removed from the blisters of the device, and a child-resistant closure, wherein said first and second members both carry parts of said child-resistant closure, said parts being engaged by a further member to close said device.

20. A device according to claim 1 in combination with said blister pack, wherein one of said first and second members has at least certain of said plurality of apertures therethrough, said blister pack having a base and said deformable blisters projecting from said base through said apertures of said one member to extend outwardly beyond said one member.

* * * * *